United States Patent [19]

Lennon

[11] 4,419,645

[45] Dec. 6, 1983

[54] MULTIPLE POSITION HALF-TURN INDUCTOR

[75] Inventor: Robert D. Lennon, Cincinnati, Ohio

[73] Assignee: Standex International Corporation, Salem, N.H.

[21] Appl. No.: 292,940

[22] Filed: Aug. 14, 1981

[51] Int. Cl.[3] ..... H01F 15/02

[52] U.S. Cl. ..... 336/65; 336/96; 336/205; 336/207; 336/208; 361/400

[58] Field of Search ..... 336/96, 205, 207, 208, 336/65; 361/400

[56] References Cited

U.S. PATENT DOCUMENTS 3,766,506 10/1973 Gaty ..... 336/192
4,065,740 12/1977 Earhart et al. ..... 336/136
4,200,853 4/1980 de Jong et al. ..... 336/205 X

FOREIGN PATENT DOCUMENTS 640520 1/1937 Fed. Rep. of Germany ..... 336/205

*Primary Examiner*—A. T. Grimley
*Assistant Examiner*—Susan Steward
*Attorney, Agent, or Firm*—Wood, Herron & Evans

[57] ABSTRACT

A one-half turn inductor is formed in a mold having a series of spaced ribs forming grooves therebetween, a U-shaped coil has its bight portion positioned in a selected one of the grooves corresponding to the inductance value of the inductor with the legs of the coil projecting beyond the cavity. Plastic is introduced into the cavity to create a coil form with the coil embedded in the plastic. The ribs and grooves form an inspection window consisting of spaced parallel rungs, one of said rungs being an exposed segment of the coil, the remainder being plastic.

8 Claims, 7 Drawing Figures

MULTIPLE POSITION HALF-TURN INDUCTOR

This invention relates to an inductor, and more particularly, the invention relates to an inductor having a one-half turn winding, the method of making the inductor and the mold for making the inductor.

A one-half turn coil or inductor consists of a U-shaped wire, which forms the winding, embedded in a plastic coil form. The U-shaped wire has a bight portion from which a pair of legs project, the legs projecting beyond the plastic coil form to permit the inductor to be mounted on a printed circuit board with an electrical connection being made to the two legs of the inductor.

In practice, the two legs are passed through a pair of holes in the printed circuit board with the coil form resting on the printed circuit board. Soldered connections are usually made on the side of the printed circuit board opposite the coil form. The length of the U-shaped winding between the soldered connections determines the inductance of the inductor.

The magnitude of the inductance, particularly in a radio frequency circuit where such inductors are commonly used, is critical. It is desired to hold that inductance to a tolerance of 1–2% so as to minimize variations in the performance of circuits which incorporate the inductor.

The current practice of making inductors involves the use of a mold into which molten plastic is flowed to surround the metallic U-shaped winding. The assembler places the U-shaped wire in the mold with its legs projecting from the mold in abutment with a precisely located stop. The stop can be moved toward or away from the mold to vary the position of the U-shaped wire in the mold. More particularly, that adjustment varies the distance between the bight portion of the U-shaped wire and the edge of the plastic coil form through which the legs of the U-shaped wire project. That in turn will vary the extent to which the wire winding projects above its soldered connections on the printed circuit board and hence its inductance. Thus, the adjustment of the position of the wire in the mold, by adjusting the position of the stop, determines the inductance to which the inductor is calibrated prior to sale for the customer.

It is further a practice to color code each plastic coil form. If there are eight different adjustments made in the stop with respect to the mold cavity, there will be eight different inductances formed in the respective inductors produced. Each of the inductors having different inductances will be colored in accordance with the standards of the Radio Manufacturers Association.

One of the problems presented by the prior methods of manufacturing described above reside in the difficulty of accurately cutting the ends of the U-shaped wire to the proper length. There may be between 0.020" and 0.030" variation in the length of one wire as compared to another. Thus, no matter how precisely the stop is located with respect to the mold cavity, the distance that the bight portion of the wire projects into the cavity will vary in accordance with the length of the wire. There can therefore be a considerable variation in inductance from inductor to inductor even though the attempt has been made, through the precise adjustment of the stop, to hold the inductance to a precise tolerance.

An objective of the present invention has been to provide an inductor as well as the method and apparatus for making it wherein the inductance can be uniformly and repeatedly maintained within a close tolerance which is totally independent of the length of the wire.

There has been another objective of the invention to provide a simple method of quality control through visual observation of the position of the wire or winding with respect to the coil form.

Another obbective of the invention has been to provide a coil form for a half turn coil which admits of the mounting of a center tap to the coil winding.

Another objective of the invention has been to provide a mold and a method of forming the inductor in the mold.

These objectives of the invention are attained primarily in the method in molding apparatus for forming the inductor. The mold provides a cavity into which the U-shaped wire is inserted. The cavity has in its center an elongated multi-position receptacle for the bight portion of the wire. More specifically, a series of spaced ribs in each mold half extend from the bottom to the top of the mold, the ribs forming between them a series of spaced parallel grooves.

The spaced grooves permit the assembler to place the bight portion of the U-shaped wire in a selected one of those grooves corresponding to the inductance to be produced in the completed inductor.

When the mold is closed, as by bringing the mating halves together, the spaced ribs within the mold cavity abut one another and create between them cylindrical recesses. One of those recesses is filled by the bight portion of the U-shaped wire which the assembler has laid there.

When the molten plastic is injected into the mold, it will fill the mold cavity and the spaced parallel cylindrical recesses. The resultant plastic coil form will include two lateral blocks of plastic in which the legs of the U-shaped wire are embedded. Between the two blocks of plastic will be a ladder effect created by the plastic flowing the the cylindrical grooves. One rung of the ladder will, however, be an exposed segment of the bight portion of the wire that was laid in the cylindrical groove and prevented molten plastic from flowing into that groove.

The space between the lateral blocks of plastic in effect forms an inspection window by which the precise vertical position of the bight portion of the wire with respect to the rungs of plastic can be visually determined.

For the purpose of this explanation, let it be assumed that the mold of the present invention presents eight grooves in the mold cavity which function to create eight different inductances depending upon which groove the bight portion of the U-shaped wire is laid in. The inductance increases approximately one nanohenry or 10% with each position. If, in the production run, the wire is to be laid in the third position, for example, the plastic used should be a translucent orange, in accordance with the RMA standards. The inspector can easily determine from looking at the inspection window through which the bight portion of the U-shaped wire is exposed whether or not the bight portion is at the third position. In the assembler had made a mistake and the bight portion is not at the third position, the inductor is at variance with the RMA standard and can be thrown away.

This construction which leaves the bight portion of the wire exposed admits of the connecting, as by welding, of a center tap to that bight portion in another assembly step.

The several objectives and features of the present invention will become more readily apparent from the following detailed description taken in conjunction with the accompanying drawings in which:

FIG. 5 is a fragmentary cross-sectional view through the mold cavity, the two mold halves being slightly separated;

Figure 1:
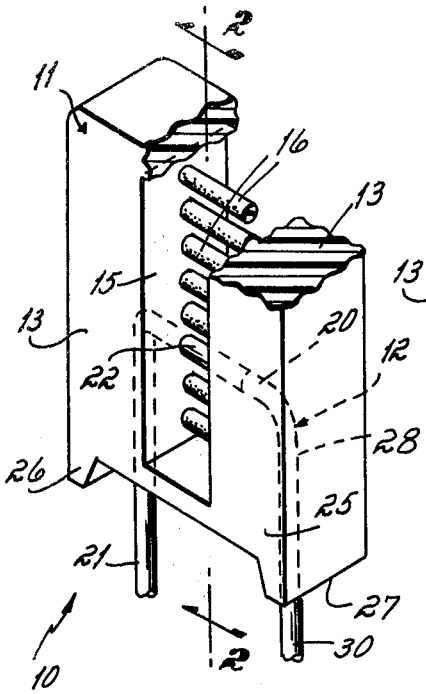
FIG. 1 is a perspective view, partially broken away, of an inductor manufactured in accordance with the present invention.
Figure 2:
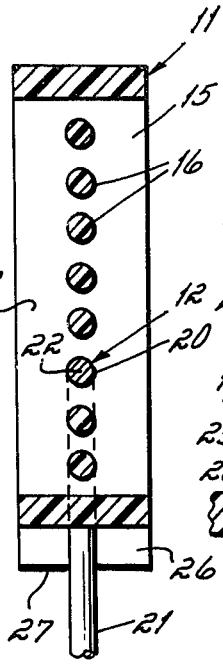
FIG. 2 is a cross-sectional view taken along lines 2—2 of FIG. 1.

Referring to FIGS. 1 and 2, an inductor 10 is shown having a plastic coil form 11, preferably polypropylene, and a U-shaped winding 12. The U-shaped winding may also be referred to as a coil or a half turn. The coil form includes two lateral blocks of plastic 13 forming an inspection window 15 between them. The inspection window consists of a plurality of spaced parallel rungs or bars 16 of plastic integral with the lateral blocks 13.

The U-shaped wire forming the coil or winding has a bight portion 20 and a pair of legs 21 extending from the bight portion. A segment 22 of the bight portion 20 is located at a selected position of one of the rungs 16 and takes the place of that rung. That segment 22 is exposed within the window 15 for visual inspection of its position within the window 15. The lower end 25 of the coil form is terminated in two feet 26 which present lower edges 27. The legs 21 of the U-shaped wire are, at their upper ends 28, partially embedded in the lateral blocks 13 of the coil form. The remainder of the legs 21 are exposed as at 30 and project below the lower edges 27 of the coil form.

Figure 3:
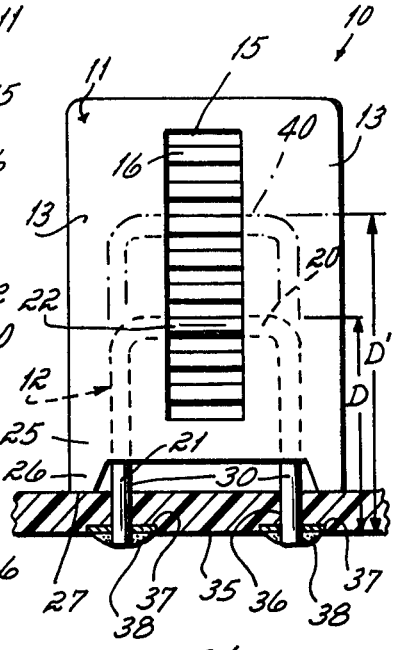
FIG. 3 is an elevational view partly in section of an inductor mounted on a printed circuit board.

The thus formed inductor is mounted on a printed circuit board 35 as shown in FIG. 3. The printed circuit board has a pair of holes through which the exposed portions 30 of the legs 21 are passed. The circuit board includes a metallic pad 37 surrounding each hole 36. After the inductor has been mounted on the printed circuit board as shown, solder 38 is applied to each pad 37 and the projecting leg 21 to make the electrical connection to the circuit board. It can be seen that the bight portion of the inductor extends above the soldered connections by a distance D. The distance determines the inductance of the half turn inductor. As D is incresed by having located the bight portion of the U-shaped winding 12 in a higher position as shown in broken lines 40 to a position D′ the inductance will increase.

Returning to FIGS. 1 and 2, it can be seen in the coil form 11 that the bight portion 20 of the winding 12 can be located in any one of eight positions corresponding to the eight positions of rungs 16, thereby admitting of the possibility of eight different inductors having eight different inductances.

Figure 4:
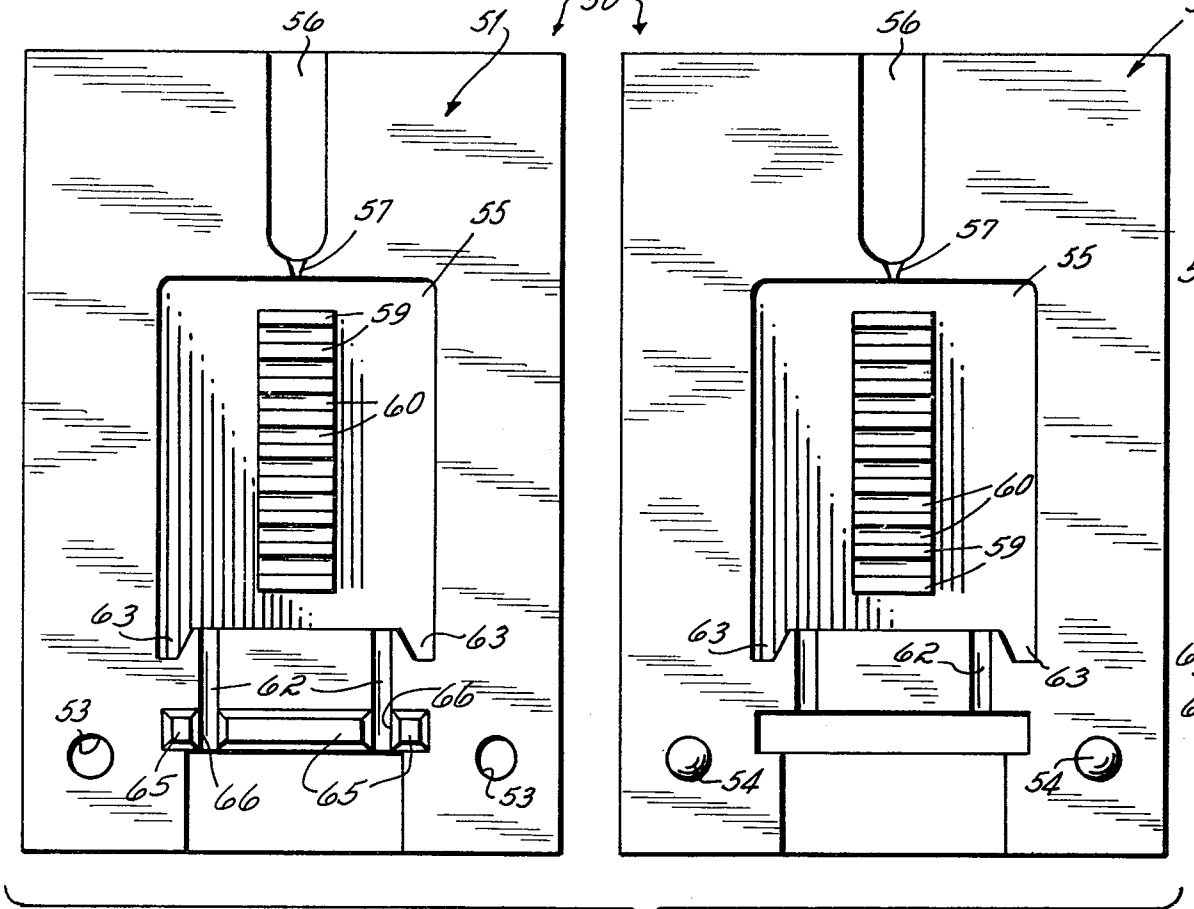
FIG. 4 is a plan view of the two mold halves by which the inductor is formed.

The mold in which the inductor of the present invention is manufactured is illustrated in FIGS. 4 and 5. Mold 50 consists of two steel mold halves 51 and 52. Mold half 51 has two bores 53 which cooperate with locating of guide pins 54 mounted on mold half 52.

Each mold half has half a mold cavity 55 which is connected by a runner or sprue 56 to a connection (not shown) by which the molten plastic is introduced into the mold half. A gate 57 between the cavity 55 and the runner 56 is provided.

At the center of each cavity, a plurality of spaced parallel ribs 59 are provided, the ribs forming between them semi-cylindrical grooves 60 whose diameter is substantially the same as the diameter of the wire which forms the inductor winding. In the illustrated embodiment, eight grooves 60 are provided to create eight vertical positions of the bight portion of the winding within the mold cavity.

It is contemplated that the illustrated mold will be suitable for making eight different inductors having eight different inductances when mounted on the printed circuit board which can be sold as on-the-shelf or proprietary items. It should be understood that the configuration of the mold cavity as well as the number of grooves 60 can be varied to create different inductors. It is even contemplated that only one groove position could be provided where large runs of inductors of a single inductance value are required.

The mold has a pair of vertical grooves 62 into which the legs of the U-shaped wire are laid to maintain their lateral position with respect to each other against the pressure of the incoming molten plastic. The mold cavity has two lower recesses 63 into which molten plastic will flow in order to create the feet 26 which fix the height D of the winding above the soldered connections 38 on the printed circuit board. Mold half 51 also includes upwardly-extending lead guides 65 having tapered recesses 66 which initially guide the assembler in laying the legs of the U-shaped wire into the mold half 51.

A single cavity mold is illustrated, and it is contemplated that a multi-cavity mold would be employed in production wherein mold cavities with all of the features described would be formed side-by-side in respective mold halves so as to form plural inductors with one injection of the molten plastic.

In the operation of the invention it would be determined that a run of a specific inductor is to be made. The assembler would be told that in this run the bight portion of the winding should be placed in the third rung position, for example. For proper color coding, an orange plastic should be employed for the coil form.

With the mold open, the operator lays a U-shaped wire in the mold cavity with the bight portion lying in the semi-cylindrical groove at the third position from the bottom of the mold (considering the foot forming recesses 63 to be at the bottom of the mold cavity). The legs of the U-shaped wire are laid in the grooves 62 using the lead guides 65 for properly locating those wires. The mold is then closed, bringing the corresponding ribs in mold half 52 into abutment with the ribs of the mold half 51. At the third rung position, the surrounding ribs form a cylinder around the bight portion of the wire and preclude the flow of plastic around the segment 22 of the wire. The remaining seven rung positions 16 remain open for plastic flow which creates the rungs 16 of the coil form and the completed inductor.

When the mold is closed, the molten polypropylene is injected into the mold cavity. When the plastic has solidified, the mold is opened and the inductor (with a runner attached) are removed. The runners may thereafter be clipped off.

Each inductor thus formed has a winding whose bight portion is precisely spaced from the edges 27 of the feet 26 of the coil form. When that inductor is mounted on a printed circuit board and soldered as shown in FIG. 3, the inductance created by the configuration should be uniform, from inductor, within a tolerance of about 1–2%.

Each inductor may be individually and visually inspected by viewing the inspection window to see that the exposed segment 22 of the winding bight portion is in the proper position, that is, corresponding to the color coding of the plastic. It it is not, the inductor may be thrown away.

Figure 6:
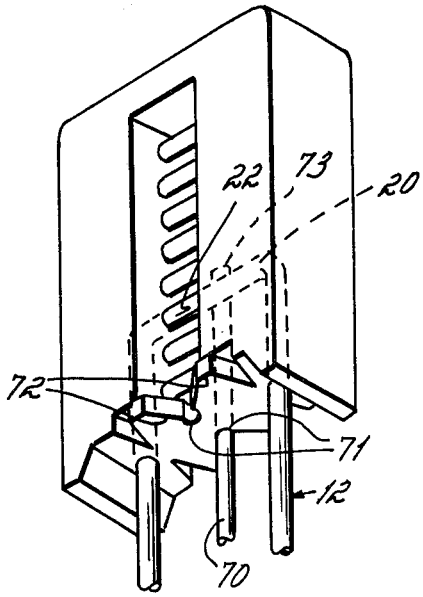
FIG. 6 is a perspective view of an alternative inductor having a center tap.

In an alternative form of the invention illustrated in FIG. 6, a center tap 70 is electrically connected to the bight portion 20 of the winding. In that form of the invention, the wire forming the center tap 70 is laid in a groove 71 formed by lugs 72 projecting outwardly from opposite surfaces of the coil form. The upper end 73 of the center tap is laid upon the exposed segment 22 of the winding. The center tap is thereafter spot-welded to the bight portion of the winding to form the center tap. The lugs 72 are formed on both sides of the coil form so that the assembler can attach the center tap to either side of the inductor. This feature eliminates a time-consuming requirement for the assembler to locate the proper side of the inductor for attachment. In order to form the lugs 72 with the recess 71, suitable recesses are formed in the mold at the edges of the respective mold cavities which will permit plastic to flow into the recesses to form the lugs.

Figure 7:
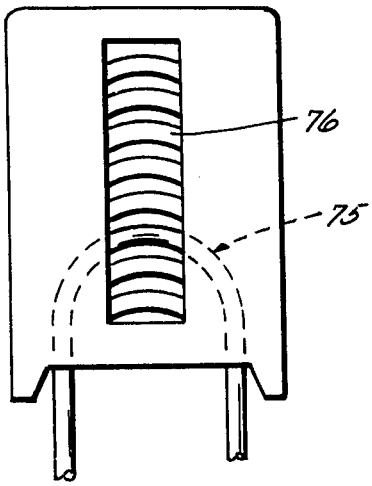
FIG. 7 is a plan view of still another alternative form of inductor.
Figure 3:
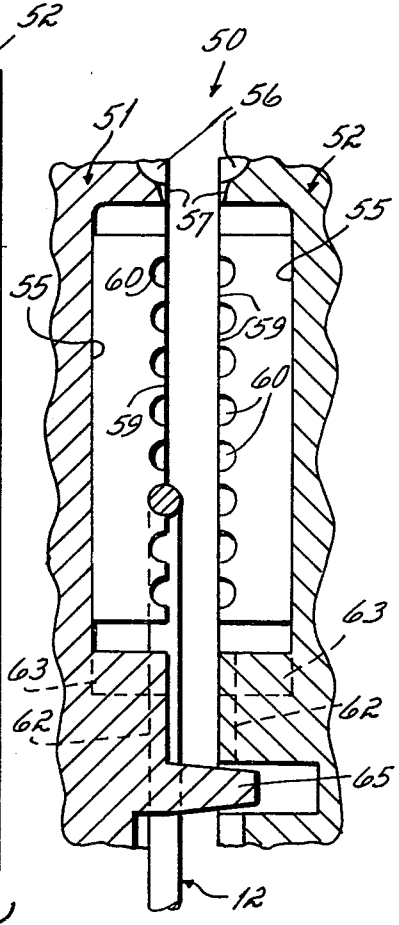

FIG. 7 illustrates still another alternative form of the invention. In that form of the invention, the bight portion of the winding 75 is semi-circular. The coil form has arcuate rungs 76 which are created by arcuate ribs in the mold cavity. These in turn create arcuate grooves into which a semi-circular the bight portion is laid during the assembly process which has been described above.

Having described my invention, I claim:

1. An inductor comprising:

a coil form;

a U-shaped one-half turn coil at least partially embedded in said coil form;

said coil having two extending legs and a bight portion;

said coil form comprising, two lateral blocks of plastic into which said legs are embedded;

and a window between said blocks;

indicia in said window indicating the inductance value of the coil by the position of the bight portion of the coil in said window;

said coil having a portion of its legs embedded in said lateral blocks of plastic, the remainder of said legs projecting below said coil form;

the bight portion of said coil lying across said window and at least a segment thereof being visible through said window.

2. An inductor as in claim 1 in which a series of spced parallel rungs extend between said lateral blocks through said window and are approximately the diameter of said coil;

said bight portion segment lying parallel to said rungs and occupying a position in said series corresponding to this inductance.

3. An inductor as in claim 1 in which said visible bight portion segment is free of embedding plastic.

4. An inductor as in claim 2 in which each of said rungs and the bight portion of said coil are arcuate.

5. An inductor as in claim 1 further comprising, a tap support at the center of the lower end of said coil form;

a metallic tap positioned in said support and extending parallel to said legs;

the upper end of said tap being spot-welded to the center of the visible segment of said bight portion.

6. An inductor comprising, a plastic coil form having an open central portion;

a series of spaced parallel rungs extending across said open central portion;

a U-shaped wire coil embedded in said plastic;

said coil having a bight portion extending across said open portion and forming one of said rungs, the remainder of said rungs being plastic;

said coil having parallel legs partially embedded in said plastic with the remainder of said legs projecting beyond said plastic for insertion into a printed circuit board.

7. An inductor as in claim 6 in which said plastic is colored in accordance with the rung position occupied by said cell.

8. An inductor and circuit board combination comprising, a coil form;

a U-shaped one-half turn coil at least partially embedded in said coil form;

said coil having two extending legs and a bight portion;

said coil form comprising, two lateral blocks of plastic into which said legs are embedded;

a window between said blocks;

indicia in said window indicating the inductance value of the coil by the position of the bight portion of the coil in said window;

said coil having a portion of its legs embedded in said lateral blocks of plastic, the remainder of said legs projecting below said coil form;

the bight portion of said coil lying across said window and at least a segment thereof being visible through said window; and a printed circuit board having at least two holes and a metallic pad surrounding each said hole at the under side of said board; the legs of said coil being passed through said board with said coil form resting on said board;

said legs being soldered to said pads.

* * * * *

UNITED STATES PATENT AND TRADEMARK OFFICE

CERTIFICATE OF CORRECTION

PATENT NO. : 4,419,645

DATED : December 6, 1983

INVENTOR(S) : Robert D. Lennon

It is certified that error appears in the above—identified patent and that said Letters Patent is hereby corrected as shown below:

Col. 2, line 40, first instance of "the" should be -- into --

Col. 2, line 63, "In" should be -- If --

Col. 3, line 55, "The" should be -- That --

Col. 5, line 8, after "from inductor" insert -- to inductor --

Col. 5, line 15, "It" should be -- If --

Col. 6, line 4, "spced" should be -- spaced --

Col. 6, line 36, "cell" should be -- coil --

Signed and Sealed this

Tenth Day of April 1984

[SEAL]

Attest:

GERALD J. MOSSINGHOFF

Attesting Officer

Commissioner of Patents and Trademarks